US007368654B1

(12) United States Patent
Wai et al.

(10) Patent No.: US 7,368,654 B1
(45) Date of Patent: May 6, 2008

(54) ANTI-RESONANT TRANSDUCER

(76) Inventors: Yu Hei Sunny Wai, 2282 Hastings Dr., Belmont, CA (US) 94002; Arnold M. Lazarus, 81 Colton Ave., Sayville, NY (US) 11782

( * ) Notice: Subject to any disclaimer, the term of this patent is extended or adjusted under 35 U.S.C. 154(b) by 423 days.

(21) Appl. No.: 11/220,285

(22) Filed: Sep. 7, 2005

(51) Int. Cl.
*G10H 3/00* (2006.01)
*G10H 3/14* (2006.01)
*G10H 3/18* (2006.01)

(52) U.S. Cl. ..... 84/723; 84/725; 84/726; 84/731

(58) Field of Classification Search ..... 84/723, 84/731, 726, 725
See application file for complete search history.

(56) References Cited

U.S. PATENT DOCUMENTS 3,626,309 A * 12/1971 Knowles ..... 329/328
4,168,647 A * 9/1979 Petillo ..... 84/731
4,280,018 A * 7/1981 Lazarus et al. ..... 381/114
4,348,930 A * 9/1982 Chobanian et al. ..... 84/726
4,911,054 A * 3/1990 McClish ..... 84/725
5,123,326 A * 6/1992 Clevinger ..... 84/743
5,438,158 A * 8/1995 Riboloff ..... 84/727
5,486,800 A * 1/1996 Davenport ..... 333/193
5,567,903 A * 10/1996 Coopersmith et al. ..... 84/723
5,877,447 A * 3/1999 Vice ..... 84/730
6,075,198 A * 6/2000 Grant et al. ..... 84/731
6,097,324 A * 8/2000 Myer et al. ..... 341/118
6,271,457 B1 * 8/2001 Hudak ..... 84/731
6,392,137 B1 * 5/2002 Isvan ..... 84/726
6,476,309 B2 * 11/2002 Gaglio ..... 84/726
6,605,771 B1 * 8/2003 Baggs ..... 84/731
6,627,808 B1 * 9/2003 Coats et al. ..... 84/723
6,689,943 B2 * 2/2004 McGuire et al. ..... 84/291
6,689,948 B2 * 2/2004 Raisanen ..... 84/733
6,706,957 B1 * 3/2004 Merkel ..... 84/314 N
7,015,390 B1 * 3/2006 Rogers ..... 84/723
7,034,218 B1 * 4/2006 Lazarus et al. ..... 84/723
7,135,638 B2 * 11/2006 Garrett et al. ..... 84/725
7,285,713 B2 * 10/2007 Takabayashi ..... 84/723
7,291,780 B2 * 11/2007 Hosler ..... 84/725
2005/0126375 A1 * 6/2005 Hosler ..... 84/726
2006/0117938 A1 * 6/2006 Gillette ..... 84/723
2006/0156913 A1 * 7/2006 Fishman et al. ..... 84/743

* cited by examiner

*Primary Examiner*—Lincoln Donovan
*Assistant Examiner*—Christina Russell

(57) ABSTRACT

The present invention is an device and method for providing an improved transducer for musical instruments.

It an object of the present invention to provide a transducer which, because of its design, can be placed on or within a musical instrument quickly and effectively.

It is yet another object of the present invention to provide a transducer which is effective over an enlarged area or sweet spot.

It is yet another object of the present invention to provide a transducer with increased gain.

These and other objects an advantages of the present invention will become clear to those skilled in the art in view of the description of the best presently known mode of carrying out the invention and the applicability of the preferred embodiment as described herein and as illustrated in the several figures of the drawings.

35 Claims, 6 Drawing Sheets

ANTI-RESONANT TRANSDUCER

FIELD OF INVENTION

The present invention relates generally to the field of electronic transducers or pickups for musical instruments.

CROSS-REFERENCES

None

STATEMENT REGARDING THE USE OF FEDERAL FUNDS

No federal funding, direct or indirect, has been utilized in conjunction with the development of the present invention.

STATEMENT REGARDING MICROFICHE RECORDS

No microfiche records are used in the application submitted for the present-invention.

PUBLICATION

The invention disclosed in this application has not and will not be the subject of an application filed in another country or under a multilateral agreement that requires publication at eighteen months after filing. Pursuant to 35 U.S.C. 122(b), this application is not to be published other than in the United States.

BACKGROUND OF THE INVENTION

No prior art can be found which discloses the present invention. No patents, no publications and no known application disclose the method or apparatus of the present invention, The prior art has produced many varieties of effective transducers for stringed instruments, however all suffer from one major drawback and that is the ease with which they can be properly placed on an instrument so as to given an undistorted signal. Except for the present invention, all existing, known or commercial transducers are very sensitive to the precise placement of the transducer on the surface of an instrument. This factor gives rise to considerable frustration and to the expenditure of many hours of tedious labor. The attaching process itself is also a problem, in that, as the attaching method can affect the result and commonly results in the production of a very distorted and unacceptable output signal. The effective distances involved are commonly measured in less than 0.001". Currently it requires patience, days or weeks of effort and considerable experience to properly place a transducer on an instrument. Further, many of the adhesives require 24 hours to 72 hours to fully dry, thus extending the time required for installation.

This placement problem has been long standing for many decades and is completely resolved by the present invention. The present invention is a new transducer, which can be placed over a much larger area on the instrument, an enlarged sweet spot, with the welcome result of allowing relatively quick installation and the avoidance of creating unwanted distortion. For a given model or type of instrument, an experienced technician can routinely and effectively place this new transducer on a stringed instrument in 5 to 10 minutes.

The new transducer can be affixed using any of a wide variety of adhesives and the, issue of drying time is not a concern. Given the fact that the components which are or which may be utilized in implementing the present invention are currently in common use for this type of application, references are given below so as to elaborate upon the unexpectedly superior performance realized by the present invention when compared with existing technologies.

Referring to U.S. Pat. No. 6,706,957, Steven L. Merkel, deals with means associated with a slotted guitar fretboard and thus is not applicable to the present invention.

Referring to U.S. Pat. No. 6,689,948, Heikki Eero Raisanen, refers to a transducer that is "uniform throughout its length" and thus is inapplicable to the present invention. Referring to U.S. Pat. No. 6,689,943, Michael D. McGuire, Jr, refers to a device that is built into the instrument and therefore is not applicable to the present invention.

Referring to U.S. Pat. No. 6,605,771, Lloyd R. Baggs, relies upon a series of gaps which are monitored and from which detection occurs. The application is remote from the present invention.

Referring to U.S. Pat. No. 6,476,309, Giovanni Gaglio, refers to a magnetic pickup that is employed in a distinguishable manner from the present invention.

Referring to U.S. Pat. No. 6,271,457, Willairn Hudak, recites a means dependent upon a pair of sensors that support a mechanical interface, which is a technology, unrelated to the present invention.

Referring to U.S. Pat. No. 4,280,018, Arnie Lazarus, at last we are dealing with a device, which is somewhat similar to the present invention in many ways to include placement, power supply, signal extraction and sensor type. Although this device has been in used for about 3 decades, it is extremely sensitive to placement and is the precise type of transducer, which has created such difficulties when being installed. It does not teach the present invention.

All of these transducers lack the favorable characteristics of the present invention. The referenced patents, all of which are typical of the patents found in the field of transducers, fail to realize or to teach the advantages of the present invention.

SUMMARY OF THE INVENTION

The present invention is a device and method for providing an improved transducer for musical instruments.

It is an object of the present invention to provide a transducer, which, because of its design, can be placed on or within a musical instrument quickly and effectively.

It is yet another object of the present invention to provide a transducer which is effective over an enlarged area or sweet spot.

It is yet another object of the present invention to provide a transducer with increased gain.

These and other objects an advantages of the present invention will become clear to those skilled in the art in view of the description of the best presently known mode of carrying out the invention and the applicability of the preferred embodiment as described herein and as illustrated in the several figures of the drawings.

DETAILED DESCRIPTION OF THE INVENTION

Figure 1:
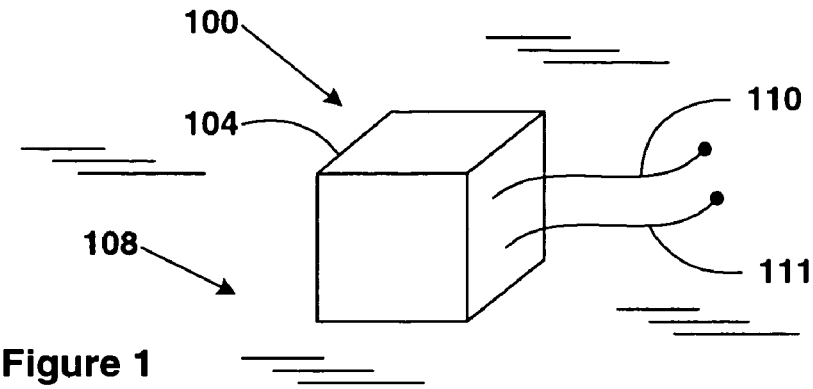
FIGS. 1-3 Perspective schematic views of transducer according to the present invention FIGS. 4A-4C Side cross-sectional schematic views of transducer FIG. 5 Side cross-sectional schematic view of transducer FIGS. 6A-6E Side cross-sectional schematic views of transducer FIGS. 7A-7C Side cross-sectional schematic views of transducer FIGS. 8A-8D Top schematic views of transducer FIG. 9A Side schematic view of transducer FIGS. 9B, 9C Top sectional schematic views of transducer

The best known implementation and the preferred embodiment of the present invention is the anti-resonant transducer as described herein below.

The present invention is comprised of a new design for a transducer for a musical instrument, commonly a stringed instrument, which produces an acceptable signal when it is placed in a substantially enlarged area on the instrument as compared with existing transducers. More particularly, existing transducers must be placed with great care, frequently to within less than 0.001" of a special location on the instrument, commonly termed a sweet spot. This sweet spot is effectively enlarged to one or more square inches when this new design is used. The advantages of using this new technology cannot be over emphasized as it avoids the expenditure of substantial amounts of time and effort by those dedicated to this task. At present, this task is widely acknowledged, particularly among musicians, to be very time consuming, difficult, in the exclusive realm of experts and to be avoided if at all possible. This problem has existed for decades and has been the source of very considerable frustration by everyone involved.

At the very least, it is not an exaggeration to say that the routine improvement in the quality of sound captured and made available to the public with this new transducer will be substantial. Here, there is no question as to its novelty, utility or nonobviousness. Of equal benefit, is the fact that a wide variety of adhesives can be used to affix the transducer to an instrument and that the resulting gain realized by the new transducer is substantially greater than for existing designs. The transducer also effectively utilizes any of a wide variety of sensors as part of the structure defined by the present invention.

The ability to appreciate and distinguish fine musical quality varies from person to person. Many times, a person does not notice or appreciate fine musical quality because their auditory senses are not trained. Training can be performed on a non hearing impaired person by listening to sets of two sounds, comparing the differing tonality and deciding the result. Many experienced musicians and most audiophiles have trained hearing.

Transducers function by converting vibrations generated when a musical instrument is played to analogous electrical signals. Normally these are then amplified by a preamp and then by an amplifier to produce an audible result.

For purposes of this specification, the term "analogous to said vibrations" is defined as producing an audible musical result which is esthetically pleasing and acceptable to an average person with trained hearing as compared to the same musical result without using a transducer. Further, the term "spurious distortion and or adverse tonality shifts" is defined as producing an acceptably small or nominal amount of audible distortion or tonality shift for an audible musical result when using a transducer as perceived by an average person with trained hearing as compared to the same musical result without using a transducer. The term "effective area" is defined as an area on a musical instrument within which a transducer can be placed or attached to give a musical result, which is analogous to said vibrations and which has only spurious distortion and or adverse tonality shifts.

The present invention describes a structure, which is effective when utilizing any one of a broad range of types of sensors and attachment means. These sensors include, without preference and without limiting to these items, piezoelectric pickups, magnetic pickups, strain gauges, accelerometers and capacitive pickups. A pickup, also called a sensor, may be structured in a great variety of ways and still be effective, however the term "the effective mass" of a pickup or sensor is defined as the mass of any pickup or sensor with or without an additional portion of a non-sensing attached mass which gives an optimum result for that pickup or sensor. Said additional portion of non-sensing mass may constitute most of the total mass of the element which responds to the vibrations to be sensed. The added weight, when used, Normally can affect and directly relates to the esthetics and or tonality of the final musical result as perceived by an average person with trained hearing. Obviously therefore, for some heavier types of pickups or sensors, this additional portion of mass may not be required. Hereinafter, the terms pickup or sensor are defined as having an effective mass.

To understand the range of applications and the details of implementing the present invention, reference is made to the drawings. Referring particularly to the figures wherein like referenced numbers have been applied to like-parts throughout the description as illustrated in the several figures of the schematic drawings.

FIG. 1 shows a perspective schematic view of the transducer, according to the present invention, which is indicated by the general reference number 100. The surface of a musical instrument, hereinafter termed wood 106, is shown to support and is affixed by an adhesive layer 109, not shown, to a sensor 104 is affixed to said wood 106 with electrical leads 110, 111 extending from said sensor 104.

Figure 2:
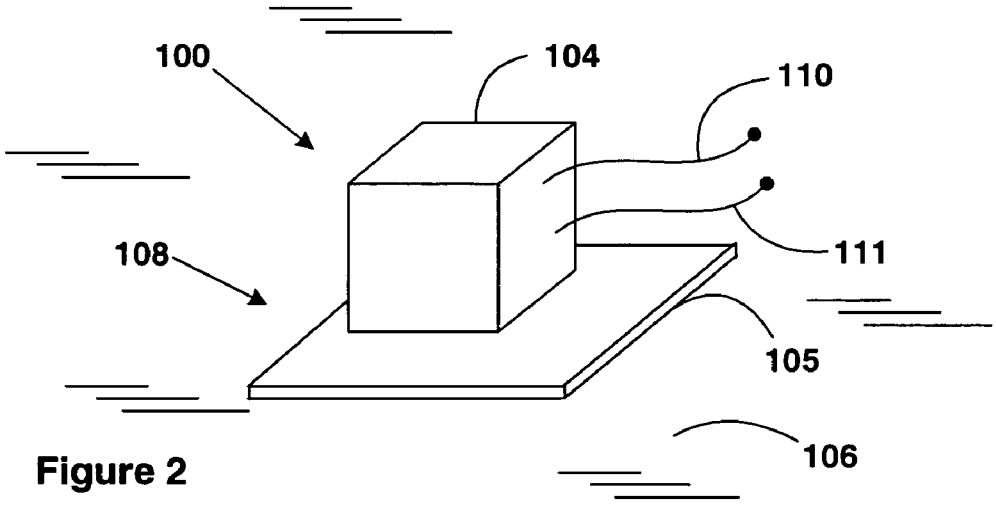

FIG. 2 shows a perspective schematic view of a second embodiment of the present invention, said sensor 104 affixed to a supporting or base layer 105, said base layer 106 affixed by an adhesive layer 109, not shown, to said wood 106, with electrical leads 110, 111 extending from said sensor 104.

Figure 3:
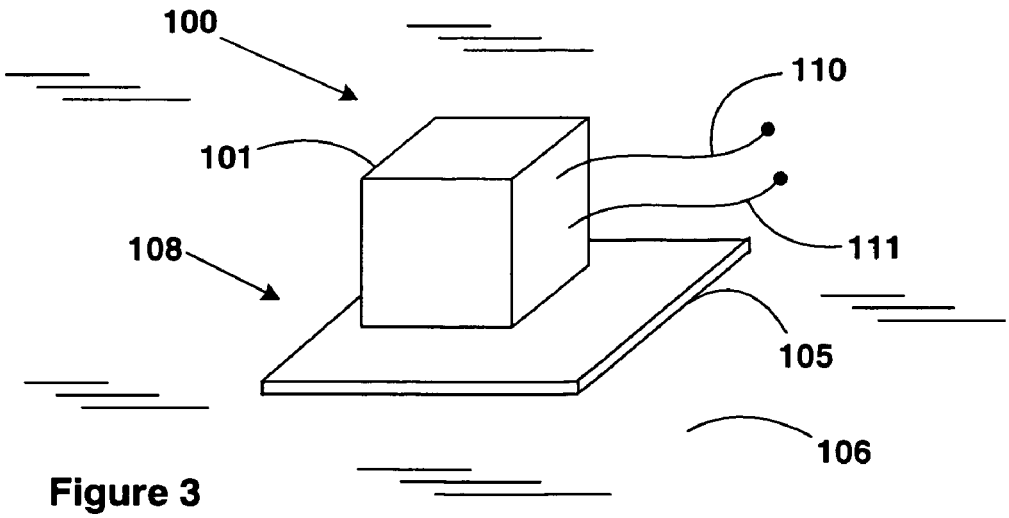

FIG. 3 shows a perspective schematic view of a third embodiment of the present invention, comprising an enclosure 101 covering said sensor 104, said sensor 104 affixed to a supporting or base layer 105 as in FIG. 2 but not shown, said base layer 105 affixed by an adhesive layer 109, not shown, to said wood 106, with electrical leads 111, 112 extending from said sensor 104. Said enclosure 101 preferably shielding said sensor 104 from electromagnetic radiation.

Figure 4A:
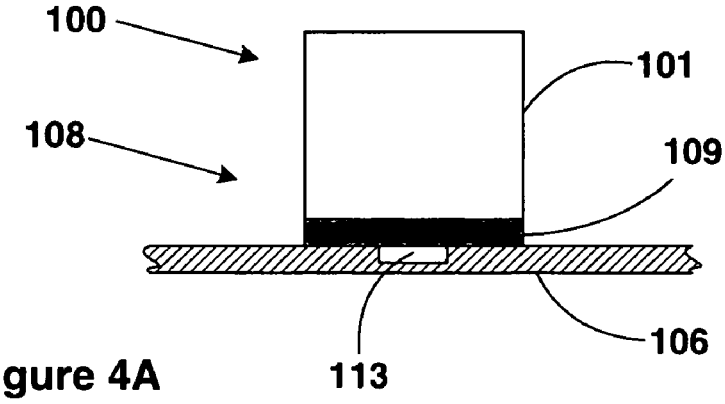
Figure 4B:
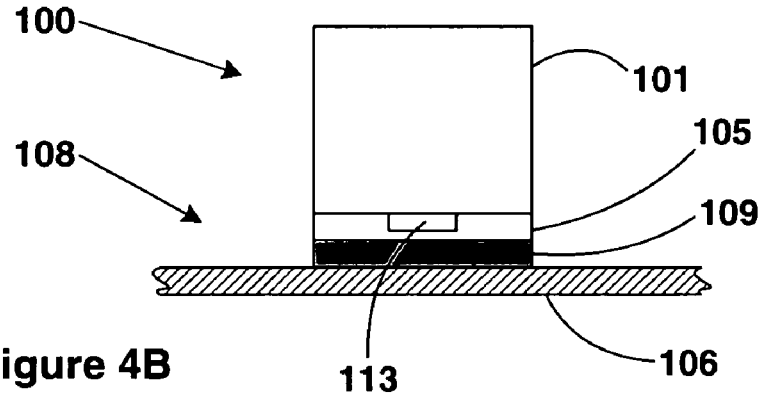
Figure 4C:
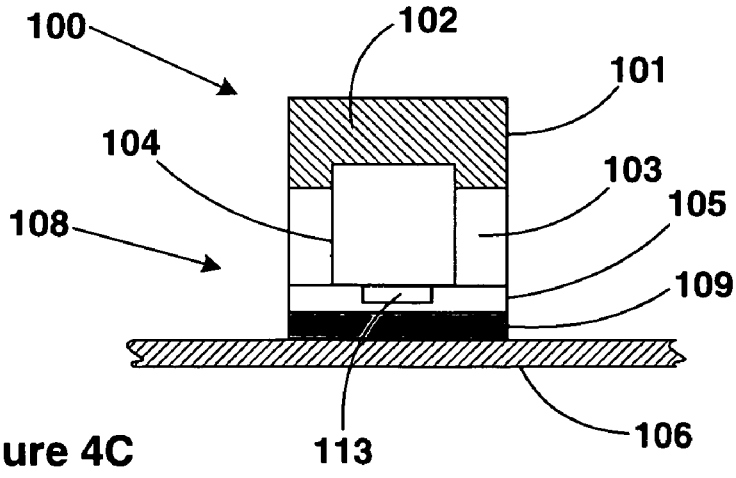

FIG. 4A shows a side sectional view of said first embodiment, FIG. 4B shows a side sectional view of said second embodiment and FIG. 4C shows a side sectional view of said third embodiment. Each view showing said wood 106, said sensor 104 and said adhesive layer 109. FIGS. 4B and 4C show said base layer 105 affixed between said, sensor 104 and said wood 106. FIG. 4C also shows said sensor 104 enclosed by said enclosure 101 with securing means between said enclosure and said sensor 104, preferably potting material 102. Said potting material 102 filling or partially filling said enclosure 101 and when not completely filling said enclosure, leaving an enclosed space 103.

Figure 5:
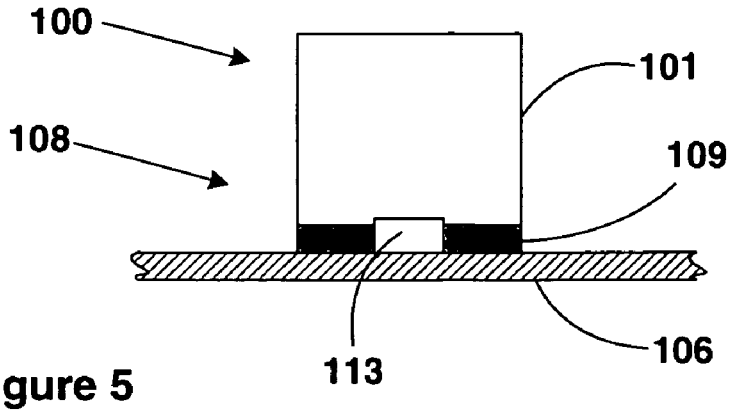

FIG. 5 shows a side view of said sensor 104 as described in said first embodiment with reduced density in or under said sensor 104. Reduced density is defined as and refers to a void in a material and not to a less dense material and is indicated in the several figures as general reference number 108. In FIG. 5, said reduced density is comprised of a blind hole or dimple 113 in said sensor 104.

Figure 6A:
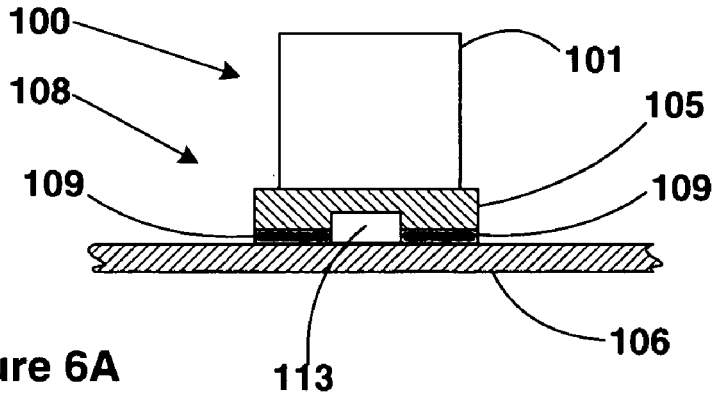
Figure 6B:
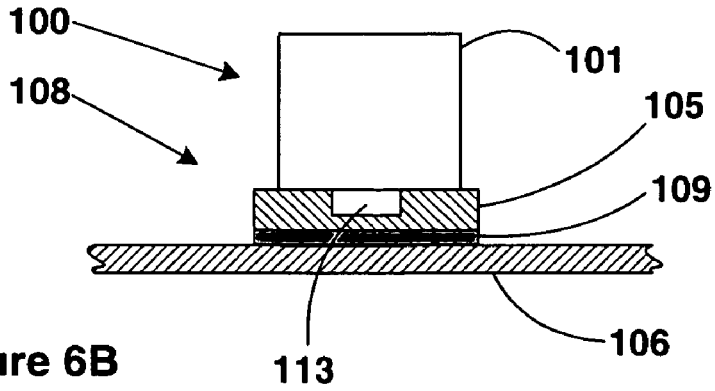
Figure 6C:
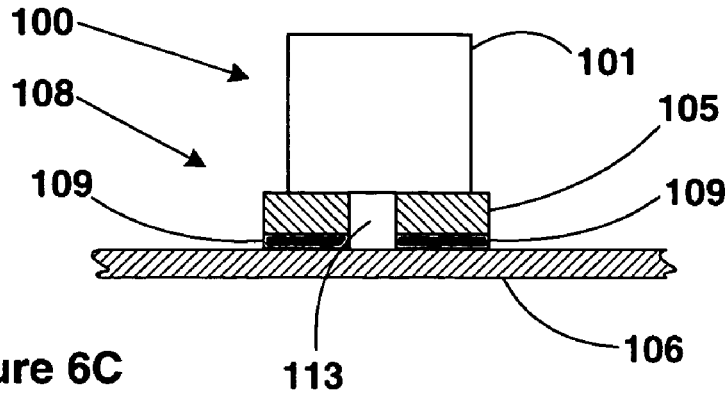
Figure 6D:
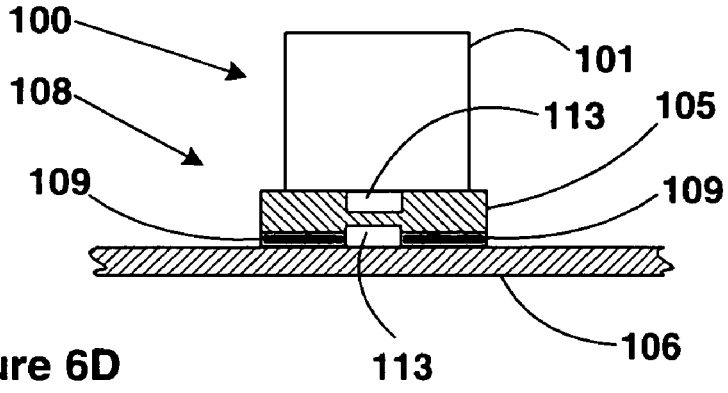
Figure 6E:
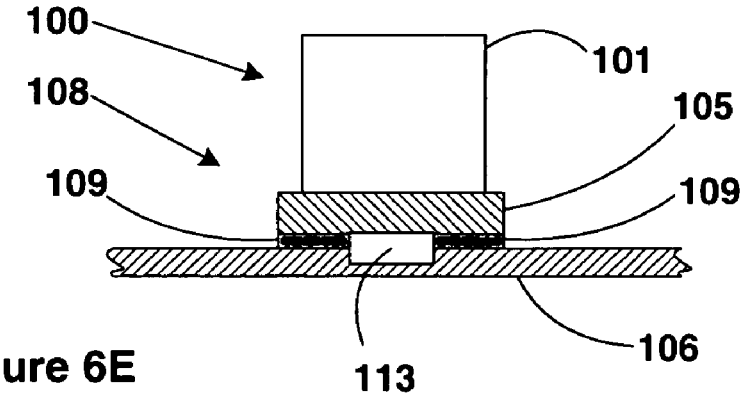

FIGS. 6A-6E show a side view of said sensor 104 as described in said second and third embodiments with reduced density under said sensor 104. In FIGS. 6A, 6B and 6C, said reduced density comprised of a blind hole or dimple 113 in either or both sides of said base piece 105 under said sensor 104. In FIG. 6D, said reduced density comprised of a penetrating hole through said base piece 105 under said sensor 104. In FIG. 6E said reduced density comprised of said blind hole or dimple 113 in said wood 106. All FIGS. 5A, 5B, 6A-6E, showing said adhesive layer 109 affixing said transducer 100 to wood 106.

Figure 7A:
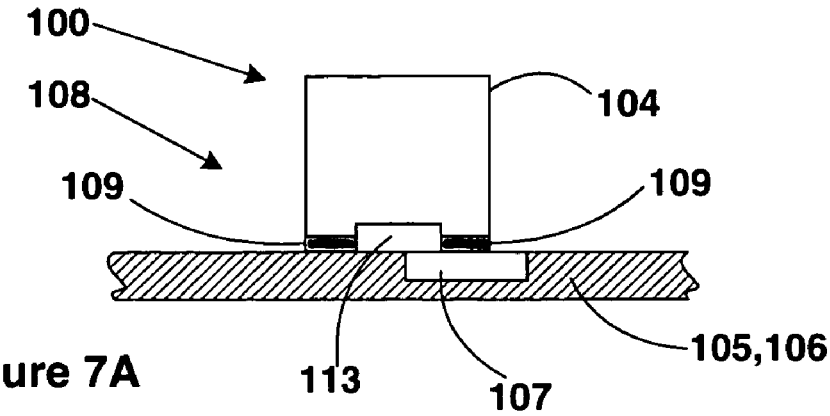
Figure 7B:
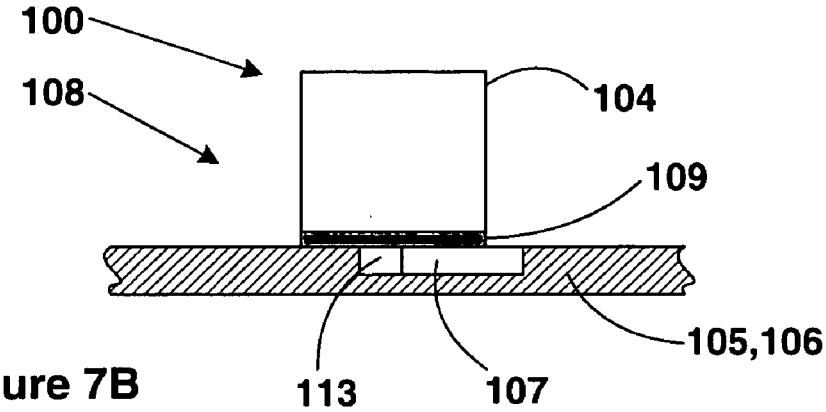
Figure 7C:
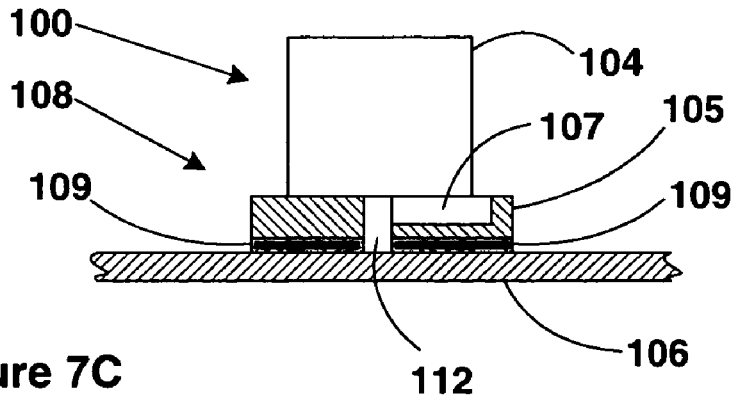
Figure 8A:
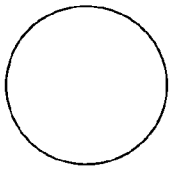
Figure 8B:
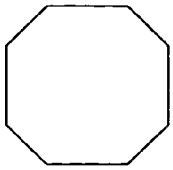
Figure 8C:
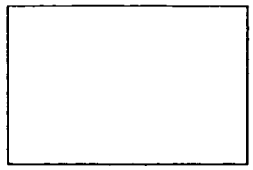
Figure 8D:
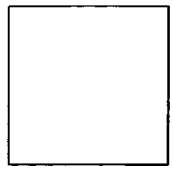

FIGS. 7A, 7B and 7C show schematic cross-sections of a sensor 104 with an opening 107 permitting venting to equalize pressure. FIGS. 7A and 7B show said opening 107 in either the base piece 105 or the wood 106. FIG. 7C shows venting for a penetrating hole 112 with said opening 107.

The size and shape of said hole 112 or partial hole or dimple 113 can affect basic esthetic considerations as regards the sound derived from the signal produced by said transducer 100, however any region of reduced density under said sensor 104 is effective in enlarging the size of the sweet spot. Tapered sides for said hole 112 also affect sound quality, however this is a subjective consideration.

Said sensor 104 typically is comprised of a piezo-electric material, an accelerometer, a magnetic pickup or a capacitive pickup. It being understood that magnetic coil pickups, accelerometers, capacitive pickups and piezo-electric pickups are all effective when affixed to the structure described herein. As one skilled in the art would appreciate, each type of sensor has its own peculiarities when being integrated into a given transducer configuration. The core concept of the present invention however does not relate to the type of sensor utilized, but to a variety of specific physical structures, any of which allow the final configuration to be effectively placed in a larger sweet spot.

FIGS. 8A through 8D each show a top schematic view of a transducer and indicate some of the various cross-sectional shapes, respectively shown as round, octagonal, rectangular and square, which are effective cross-sectional shapes for implementing the technology disclosed by the present invention.

Figure 9A:
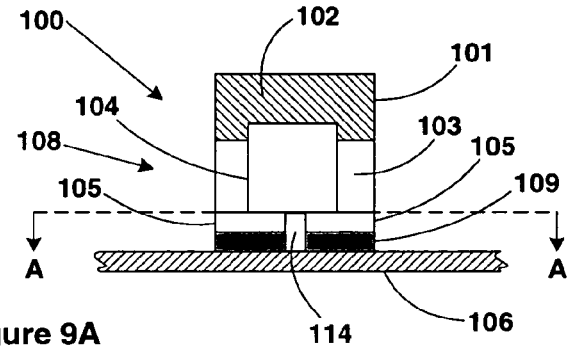
Figure 9B:
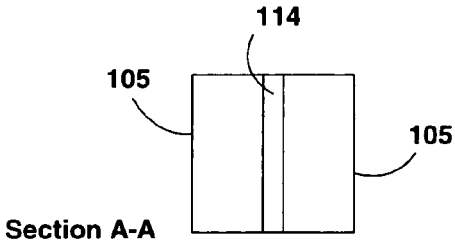
Figure 9C:
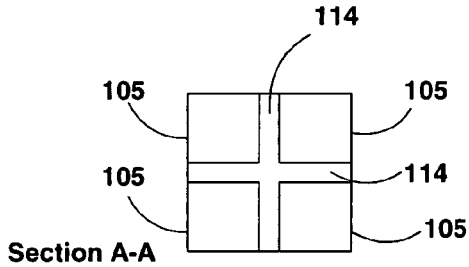

In another embodiment of the present invention, FIGS. 9A, 9B and 9C schematically show said base layer 105 on which or to which the sensor 104, is attached, said base layer 105 being comprised of at least two separate pieces as shown in FIG. 9B, a schematic sectional top view indicating division into two pieces. FIG. 9C shows division into four pieces. FIG. 9A shows a schematic side view of these configurations with sectional plane A. A downward toward said substrate as shown in FIGS. 9B, 9C. The gaps or grooves 114 schematically shown separating pieces of said base layer 105 create a reduced density, with equally favorable results.

In yet another embodiment of the present invention, the transducers as disclosed above and shown in FIGS. 1 through 7 and 9A having reduced density or voids 108 function effectively with these regions filled, totally or in part, with a more dense substance than the surrounding material, said more dense substance to include, but not limited to, solder. Said transducers having said voids filled, totally or in part, with said more dense substance also allowing effective placement of the transducer in an enlarged sweet spot.

The transducer according to the present invention functions in the following manner. Vibrations in an instrument, when played or struck, in this case wood 106, are transmitted through said adhesive 109 to said base piece 105, and hence to said sensor 104, said vibrations in said sensor 104 produce an electric signal in said leads 110, 111. Said electrical signals then being amplified by an amplifier means, not shown, to produce an audible result.

Thus an improved structure for a transducer for a musical instrument has been shown. All of the above are only some of the examples of available embodiments of the present invention. Accordingly, the above disclosure is not intended as limiting and the appended claims are to be interpreted as encompassing the entire scope of the invention.

REFERENCE NUMERALS

Description

| Numeral | Description |
|---|---|
| 100 | General reference number for transducer according to the present invention |
| 101 | Enclosure |
| 102 | Potting compound |
| 103 | Enclosed space |
| 104 | Sensor |
| 105 | Base layer |
| 106 | Wood |
| 107 | Opening |
| 108 | General reference number for a region of diminished thickness, reduced density or increased density |
| 109 | Adhesive layer |
| 110, 111 | Electrical connections |
| 112 | Penetrating hole |
| 113 | Blind hole or dimple |
| 114 | Slot or groove |

What is claimed is:

1. A transducer for a musical instrument comprised of:

a sensor attached by affixing means to the surface of said musical instrument within an effective area, at least one central region of the contact area between said sensor and said musical instrument wherein said sensor and or said musical instrument have reduced density or different density, electrical conducting means affixed to the sensing element of said sensor, said electrical conducting means connected to an amplifying means, vibrations created in said musical instrument by playing or striking said musical instrument, said vibrations communicated to said sensing element, electrical signals generated by said sensing element by said vibrations, said electrical signals conducted by said electrical conducting means to said amplifying means, whereby said amplifying means produces audible sounds analogous to the sounds produced by said musical instrument with minimal spurious distortion and or nominal adverse tonality shift.

2. A transducer as in claim 1 whereby said affixing means is an adhesive or wax.

3. A transducer as in claim 1 whereby said sensor is a strain gauge, piezoelectric sensor, a magnetic sensor, an accelerometer or a capacitive sensor.

4. A transducer as in claim 1 whereby said reduced density comprises at least one hole, partial hole or depression and or dimple in said musical instrument and or in said sensor.

5. A transducer as in claim 4 whereby said reduced density includes an opening to ambient air pressure.

6. A transducer as in claim 1 whereby said musical instrument is a guitar or other stringed instrument.

7. A transducer for a musical instrument comprised of:

a supporting layer defining an area and an outer surface and an inner surface, a sensor centrally attached to said inner surface, said outer surface attached to the surface of said musical instrument by attachment means within an effective area, within said central region, at least one portion of said sensor and or said supporting layer and or said musical instrument having reduced density or different density, electrical conducting means affixed to the sensing element of said sensor, said electrical conducting means connected to an amplifying means, vibrations created in said musical instrument by playing or striking said musical instrument, said vibrations communicated to said sensing element, electrical signals generated by said sensing element by said vibrations, said electrical signals conducted by said electrical conducting means to said amplifying means, whereby said amplifying means produces audible sounds analogous to the sounds produced by said musical instrument with minimal spurious distortion and or nominal adverse tonality shift.

8. A transducer as in claim 7 whereby said at least one region of reduced density comprises at least one hole through said supporting layer and or at least one depression in or on either or both sides of said supporting layer and or at least one depression in said musical instrument and or in said sensor.

9. A transducer as in claim 8 whereby said reduced density includes an opening to ambient air pressure.

10. A transducer as in claim 7 whereby said affixing means is an adhesive or wax.

11. A transducer as in claim 7 whereby said sensor is a strain gauge, piezoelectric sensor, a magnetic sensor, an accelerometer or a capacitive sensor.

12. A transducer as in claim 7 whereby said musical instrument is a guitar or other stringed instrument.

13. A transducer for a musical instrument comprised of:

a supporting layer defining an area having an outer surface and an inner surface, a sensor attached to a central region of said inner surface, said outer surface affixed by attachment means to an exposed surface of a musical instrument within an effective area, within said central region, at least one portion of said sensor and or said supporting layer and or said musical instrument having reduced density or reduced density, electrical conducting means affixed to the sensing element of said sensor, said electrical conducting means connected to an amplifying means, a shielding enclosure covering and attached to said sensor by securing means, vibrations created in said musical instrument by playing or striking said musical instrument, said vibrations communicated to said sensing element, electrical signals generated by said sensing element by said vibrations, said electrical signals conducted by said electrical conducting means to said amplifying means, whereby said amplifying means produces audible sounds analogous to the sounds produced by said musical instrument with minimal spurious distortion and or nominal adverse tonality shift.

14. A transducer as in claim 13 whereby said at least one region of reduced density comprises at least one hole through said supporting layer and or at least one depression in, on either or both sides, of said supporting layer and or at least one depression in said musical instrument and or in said sensor.

15. A transducer as in claim 14 whereby said reduced density includes an opening to ambient air pressure.

16. A transducer as in claim 13 whereby said attachment means is an adhesive or wax.

17. A transducer as in claim 13 whereby said sensor is a strain gauge, piezoelectric sensor, a magnetic sensor, an accelerometer or a capacitive sensor.

18. A transducer as in claim 13 whereby said enclosure shields against electromagnetic energy.

19. A transducer as in claim 13 whereby said securing means is potting material filling a portion or all of said enclosure.

20. A transducer as in claim 13 whereby said musical Instrument is a guitar or other stringed instrument.

21. A transducer as in claim 13 whereby said at least one region of reduced density or different density comprises a penetrating hole through said supporting layer and or at least one depression in, on either or both sides, of said supporting layer and or a depression in said musical instrument and or in said sensor, and whereby said securing means is a potting material filling a portion or all of said enclosure, and whereby said sensor is a piezoelectric sensor, and whereby said enclosure shields against electromagnetic energy and whereby said musical instrument is a guitar.

22. A transducer as in claim 21 whereby said at least one region of different density comprises said penetrating hole through said supporting layer and or at least one depression in, on either or both sides, of said supporting layer and or a depression in said musical instrument and or in said sensor is filled with a substance more dense than the surrounding material, to include solder.

23. A method of configuring a transducer for a musical instrument for the attachment of said transducer to said musical instrument comprised of the following steps:

creating reduced density or different density in said transducer and or in said musical instrument in at least one region in or between said transducer and said musical instrument, attaching said transducer to the surface of said musical instrument by affixing means, within an effective area, playing or striking said musical instrument creating vibrations in said musical instrument, generating electrical signals in said transducer derived from said vibrations, communicating said vibrations to said sensing element, conducting said electrical signals by electrical conducting means to an amplifier, creating audible sounds from said electrical signals with said amplifier, said audible sounds analogous to the sounds produced by said musical instrument with minimal spurious distortion and or nominal adverse tonality shift.

24. A method as in claim 23 whereby said region of reduced density is at least one depression in said transducer and or in said musical instrument.

25. A method as in claim 23 whereby said at least one region of reduced density is at least one gas filled or solder filled void.

26. A method as in claim 25 whereby said reduced density includes an opening to ambient air pressure.

27. A method as in claim 23 whereby said sensor is a strain gauge, piezoelectric sensor, a magnetic sensor, an accelerometer or a capacitive sensor.

28. A method as in claim 23 whereby said affixing means is an adhesive or wax.

29. A method as in claim 23 whereby said musical instrument is a guitar or other stringed instrument.

30. A transducer for a musical instrument comprised of:

a supporting layer defining an area and an outer surface and an inner surface, a sensor centrally attached to said inner surface, said outer surface attached to the surface of said musical instrument by attachment means within an effective area, within said central region, at least one portion of said sensor and or said supporting layer and or said musical instrument having reduced density or different density, electrical conducting means affixed to the sensing element of said sensor, said electrical conducting means connected to an amplifying means, vibrations created in said musical instrument by playing or striking said musical instrument, communicating said vibrations to said sensing element, electrical signals generated by said sensing element by said vibrations, said electrical signals conducted by said electrical conducting means to said amplifying means, said supporting layer comprised of at least two pieces, whereby said amplifying means produces audible sounds analogous to the sounds produced by said musical instrument with minimal spurious distortion and or nominal adverse tonality shift.

31. A transducer as in claim 30 whereby said supporting layer is comprised of two separate pieces.

32. A transducer as in claim 30 whereby said supporting layer is comprised of four separate pieces.

33. A method of configuring a transducer for a musical instrument for the attachment of said transducer to said musical instrument comprised of the following steps:

creating reduced density or different density in said transducer and or in said musical instrument in at least one region in or between said transducer and said musical instrument, attaching said transducer to a supporting layer comprised of at least two pieces, attaching said supporting layer to the surface of said musical instrument by affixing means, within an effective area, playing or striking said musical instrument creating vibrations in said musical instrument, communicating said vibrations to said sensing element, generating electrical signals in said transducer derived from said vibrations, conducting said electrical signals by electrical conducting means to an amplifier, creating audible sounds from said electrical signals with said amplifier, said audible sounds analogous to the sounds produced by said musical instrument with minimal spurious distortion and or nominal adverse tonality shift.

34. A method as in claim 33 whereby said supporting layer is comprised of two pieces.

35. A method as in claim 33 whereby said supporting layer is comprised of four pieces.

* * * * *